US008182299B2

(12) United States Patent
Schrader

(10) Patent No.: US 8,182,299 B2
(45) Date of Patent: May 22, 2012

(54) ELECTRICAL CONNECTION DEVICE

(75) Inventor: Andreas Schrader, Delbrück (DE)

(73) Assignee: Phoenix Contact GmbH & Co. KG (DE)

( * ) Notice: Subject to any disclaimer, the term of this patent is extended or adjusted under 35 U.S.C. 154(b) by 0 days.

(21) Appl. No.: 12/808,796

(22) PCT Filed: Jan. 24, 2009

(86) PCT No.: PCT/EP2009/000459
§ 371 (c)(1),
(2), (4) Date: Jul. 12, 2010

(87) PCT Pub. No.: WO2009/100812
PCT Pub. Date: Aug. 20, 2009

(65) Prior Publication Data

US 2010/0311286 A1 Dec. 9, 2010

(30) Foreign Application Priority Data

Feb. 14, 2008 (DE) ..... 10 2008 009 357

(51) Int. Cl.
*H01R 13/11* (2006.01)

(52) U.S. Cl. ..... 439/857; 439/839

(58) Field of Classification Search ..... 439/839, 439/857, 856, 947
See application file for complete search history.

(56) References Cited

U.S. PATENT DOCUMENTS

| | | | | |
|---|---|---|---|---|
| 3,869,192 | A * | 3/1975 | Maier et al. | 439/857 |
| 4,351,583 | A | 9/1982 | Belttary | |
| 4,553,799 | A | 11/1985 | Deters | |
| 4,583,812 | A | 4/1986 | Gross, Jr. et al. | |
| 4,845,589 | A * | 7/1989 | Weidler et al. | 361/614 |
| 4,932,877 | A | 6/1990 | Zinn | |
| 4,932,906 | A * | 6/1990 | Kaley et al. | 439/857 |
| 5,827,094 | A * | 10/1998 | Aizawa et al. | 439/857 |
| 5,868,590 | A | 2/1999 | Dobbelaere | |
| 6,062,918 | A | 5/2000 | Myer et al. | |
| 6,247,976 | B1 * | 6/2001 | Chiu | 439/857 |
| 6,722,926 | B2 * | 4/2004 | Chevassus-More | 439/721 |

FOREIGN PATENT DOCUMENTS

| | | |
|---|---|---|
| DE | 8811020 U1 | 10/1988 |
| EP | 0786830 A1 | 7/1997 |
| JP | 2005/019199 | 1/2005 |

* cited by examiner

*Primary Examiner* — Hien Vu
(74) *Attorney, Agent, or Firm* — Harness, Dickey & Pierce, P.L.C.

(57) ABSTRACT

The invention relates to an electrical connection device for transmitting high current levels, comprising at least one flat contact having a tulip contact and a contact blade having a prescribed blade thickness, wherein the flat contact is suitable for receiving the contact blade having the prescribed blade thickness. A contact force for contacting is applied by an upper spring in the contact area. The tulip contact comprises a free entry width in an unloaded state that approximately corresponds to the prescribed blade thickness.

10 Claims, 2 Drawing Sheets

ELECTRICAL CONNECTION DEVICE

CROSS-REFERENCE TO RELATED APPLICATIONS

This application is a National Stage of International Application No. PCT/EP2009/000459, filed Jan. 24, 2009. This application claims the benefit and priority of German application 10 2008 009 357.2, filed on Feb. 14, 2008. The entire disclosures of the above applications are incorporated herein by reference.

BACKGROUND

This section provides background information related to the present disclosure which is not necessarily prior art.

1. Technical Field

The invention relates to an electrical connection device, particularly for transmitting high current levels such as are required in various technical areas. For example, current levels of 125 amperes and more are transmitted at voltages of up to 1,000 volts. To do this, conductors with cross-sections of 25 or 35 $mm^2$ may be required.

2. Discussion

Different electrical connection devices are known in the prior art for transmitting high current levels. They included flat contacts and particularly round-pin contacts in which the contact point is configured essentially rotationally symmetrical. Usually plugs with machined contact parts are used for high current levels of this order to transmit the current levels involved reliably.

A spring arm contact with an external upper spring to transmit electrical currents is known from DE 88 11 020 U1 wherein the spring arm contact has a spring arm base and spring arms extending forward. The contact force in the area of the contact point is transmitted by the spring arms, which have to be pressed apart against their clamping force when a blade contact is inserted. The external upper spring prevents the spring arms from bending upward and provides support for the spring arms. The disadvantage of using a spring arm contact of this type is that over time the copper material spring arms suffer from settling, which substantially reduces the spring force as a consequence, possibly resulting in operating malfunctions. In order to maintain the required clamping force permanently, a high initial clamping force must be provided in the basic state, causing considerable diminution in convenience when in use since it requires correspondingly high operating forces to insert and remove plug connectors of this type.

In the case of the commercially available round-pin connectors, the required current can be transmitted but they are complicated to produce, which is reflected in relatively high costs. In addition, they are relatively large in size which is not desirable in multi-pin connectors.

SUMMARY OF THE INVENTION

Therefore, against the background of the prior art as described, it is an object of the present invention to provide an electrical connection device that is suitable for transmitting high current levels and in which low insertion and removal forces are required while current is transmitted reliably on a permanent basis.

The electrical connection device in accordance with the preferred embodiment invention is particularly suitable for transmitting high current levels and comprises at least one flat contact with a tulip contact and a contact blade with a specified blade thickness, wherein the flat contact is suitable to receive the contact blade of the specified thickness. In accordance with the invention, a force designed to make electrical contact is exerted by an upper spring in the contact area. In an unloaded state, the tulip contact comprises a free entry width that corresponds approximately to the prescribed blade thickness of the contact blade.

The electrical connection device in accordance with the invention offers considerable advantages. Specific contact forces can be applied through the use of the upper spring. The solution in accordance with the invention, in which the upper spring applies the contact force precisely in the contact area, has the considerable advantage that consequently settling at the tulip contact plays no part, or essentially no part.

In the prior art in accordance with DE 88 11 020 U1 the outer upper spring extends only over one part of the length of the spring arms, and the outer upper spring does not bear against the contact point but spaced apart therefrom. Consequently, settling at the spring arms transmitting the current level can result in substantial changes in the contact force. In the present invention, the various tasks are separated, whereby the tulip contact is provided to transmit the current level, and whereby the upper spring serves to apply the contact force. As a result of the strict separation of the two functional areas, reliable and permanently stable current transmission can be ensured.

In accordance with the invention, it is basically immaterial whether a small proportion of the contact force is still transmitted through the tulip contact or not since the major part of the contact force is applied in the contact area through the upper spring in any case. The free entry width of the tulip contact in its unloaded state corresponds approximately to the blade thickness of the contact blade to be inserted. As a result, without the presence of outer springs, the contact blade as such could be inserted into the tulip contact without the application of force, however the transmission of current would not be stable. The outer spring, which preloads the contact area with the specified contact force, therefore serves to ensure the contact force necessary to transmit current. Defined conditions are in effect that are maintained on a permanent basis independently of any settling that occurs at the tulip contact.

As a result it is practicable to reduce the actual contact force, achieving greater operating comfort and making it easier both to insert and to remove a contact.

The tulip contact in particular has at least two contact arms that are spaced apart from each other in the contact area by the amount of the width of the entry.

In a refinement in accordance with the invention, push-through protection is provided that prevents unintentional push-through, particularly in the rear area of the tulip contact.

The push-through protection can be designed as a bridge connecting the two contact arms of the tulip contact so that simple and effective push-through protection is made available.

In a preferred refinement of the invention, the upper spring and the tulip contact have a plurality of blades, or pairs of contact fingers, assigned to them respectively. For example, three, four, five, six or even more pairs of contact fingers can be provided that together form the tulip contact or its contact arms respectively.

A corresponding number of pairs of upper spring fingers is then preferably provided, wherein one pair of upper spring fingers is respectively assigned to one pair of contact fingers. In particular, one upper spring finger presses against one contact finger on the tulip contact so that preferably each contact finger is essentially equally loaded.

In a preferred refinement of the invention, at least one length of the contact fingers on the tulip contact is considerably greater than a corresponding length of the upper spring fingers of the upper spring. In particular, the areas of the upper spring fingers running towards one another at an angle are considerably shorter than the areas of the contact fingers running towards one another. Preferably the upper spring fingers run at a considerably greater angle to the receiving space with a contact blade received than the upper spring fingers to the receiving space or the contact blade. The result of this is that the spring force of the upper spring is relatively great, while as a result of the long and relatively shallow angle of the contact spring fingers a low spring rate and a large contact area is made available. The contact force is applied in large part, or even almost completely, by the upper spring.

In all embodiments, the electrical connection device is designed particularly for contact forces below 30 and specifically below 20 N. Preferably each pair of contact fingers applies contact forces of below 7 and particularly below 5 N. In particularly preferred embodiments, contact forces between approximately 3 and 4 N are applied per pair of contact fingers. This permits a high degree of operating comfort since only relatively low insertion and withdrawal forces are required when creating or breaking an electrical contact with an electrical connection device.

The exact number of contact fingers and upper fingers and the respective contact force depends particularly on the current level to be transmitted.

In preferred embodiments of the electrical connection device in accordance with the invention, at least one contact surface of the tulip contact has a layer containing silver. Layers with a silver content or of silver can reduce friction considerably so that it is possible to improve comfort during operation even further. A further advantage of silver or layers containing silver is good electrical conductivity.

In other embodiments it is also possible to apply layers containing tin or consisting of tin in order to reduce friction and to prevent corrosion.

In all embodiments the electrical connection device in accordance with the invention is suitable for transmitting current levels above 80 amperes. It is preferably suitable for transmitting current levels above 100 amperes.

The tulip contact advantageously consists at least partially of copper material and specifically of a copper flat strip material that is, for example, stamped and brought to the desired shape by bending.

The upper spring preferably consists largely of steel material and can similarly be produced from a flat strip material through one or more bending processes. The push-through protection can be formed by two areas bent onto one another.

The electrical connection device in accordance with the invention can both be located on a terminal block and designed as a plug connector. A floating arrangement is also possible.

In addition to the previously described embodiments of the invention, additional advantageous configurations of the invention are given in the dependent claims.

BRIEF DESCRIPTION OF THE DRAWINGS

Further features and advantages of the invention result from the following description which in connection with the enclosed Figures explains the invention in more detail with reference to an embodiment.

The drawings described herein are for illustrative purposes only of selected embodiments and not all possible implementations, and are not intended to limit the scope of the present disclosure.

Figure 1:
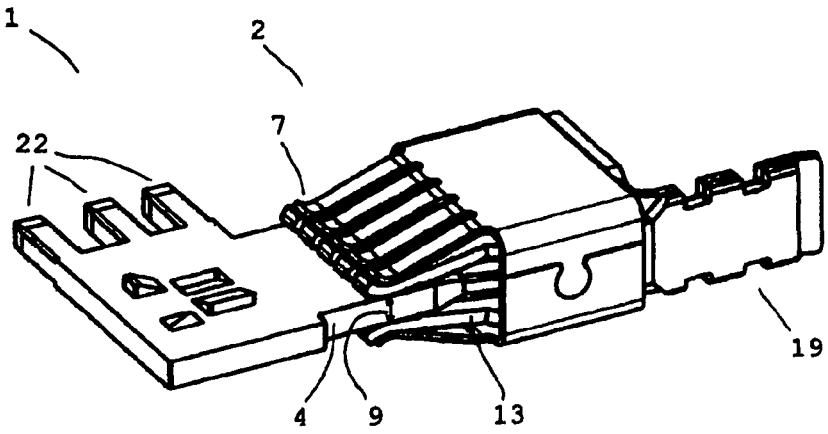

One embodiment of the invention is shown purely schematically in the drawings and is described hereinafter in greater detail.

Figure 2:
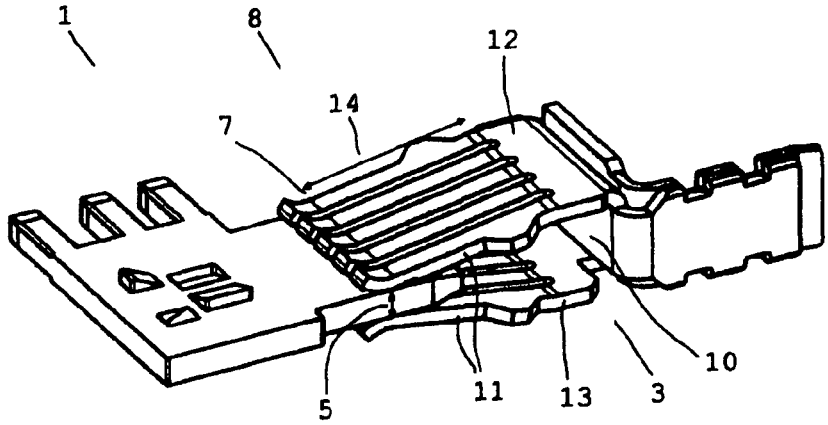
Figure 3:
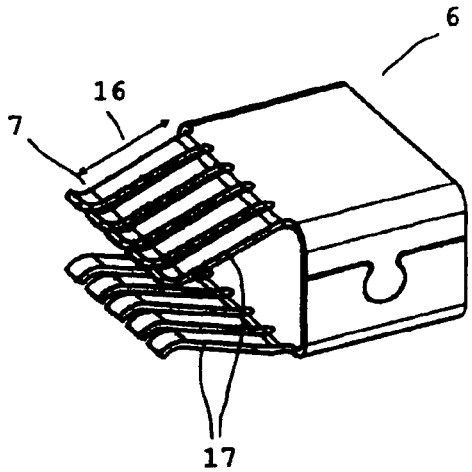
Figure 4:
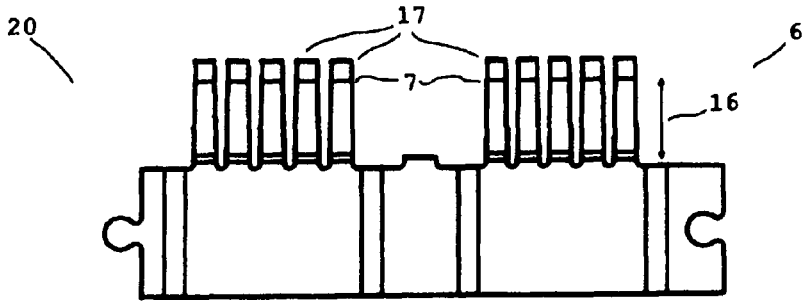
Figure 5:
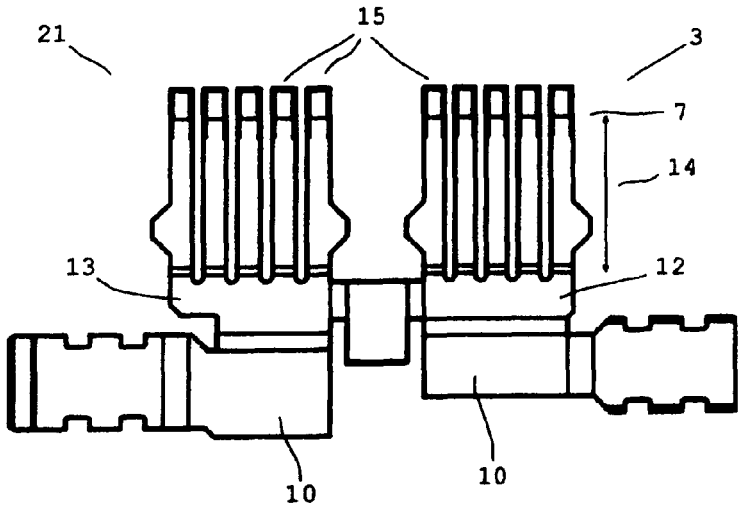
Figure 6:
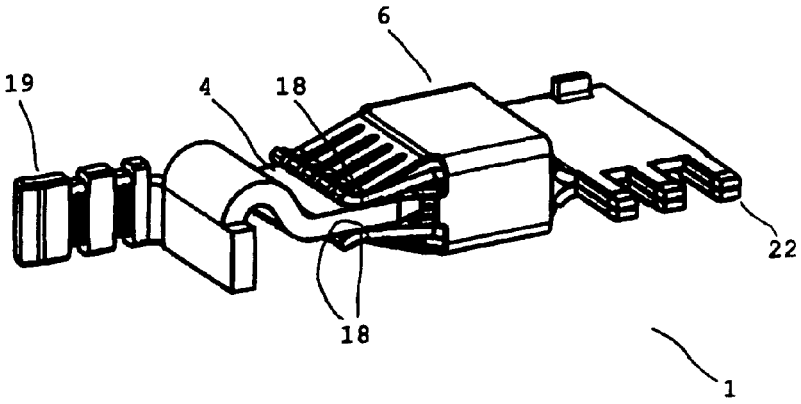

FIG. 1 shows the electrical connection device in accordance with the invention in a perspective view;

FIG. 2 shows a perspective view of the electrical connection device from FIG. 1 without the upper spring;

FIG. 3 shows a perspective view of the upper spring of the electrical connection device from FIG. 1;

FIG. 4 shows a flat blank for the upper spring of the electrical connection device from FIG. 1;

FIG. 5 shows a flat blank for the tulip contact of the electrical connection device from FIG. 1; and FIG. 6 shows a perspective view of a further electrical connection device in accordance with the invention.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

A connection contact device in accordance with the invention in the form of an electrical connection contact, or electrical connection device 1, is shown in FIG. 1 in a perspective view. The electrical connection device 1 comprises a flat contact 2 with at least one tulip contact 3 and an upper spring 6 enclosing the tulip contact 3 outwardly that serves to ensure the necessary contact force.

The tulip contact 3 comprises springs arms 12 and 13, as can be deduced in particular from the view in accordance with FIG. 2 and the flat blank shown in FIG. 5. Each contact arm comprises a plurality of contact fingers 15, five in this embodiment, that are configured in pairs so that in each case two contact fingers 15 are directed towards each other.

In the unloaded state 8, a specified entry width 9 is provided between one contact finger pair with two contact fingers 15 that at least in large part corresponds to the prescribed blade thickness 5 of the contact blade 4. The effect of this is that it is not the spring arms 12 and 13 of the tulip contact 3 that generate the required clamping force but that the required contact force is generated by the upper spring fingers 17 of the upper spring 6.

The upper spring preferably consists of steel or other similar stable material, while the tulip contact with the pairs of contact fingers 11 preferably consist of copper or a copper alloy.

The contact fingers 15 as a whole, or the contact surface 18, can be provided with a silver coating or a coating containing silver for better conductivity and to reduce friction. This achieves a reduction in friction, thereby increasing operating comfort through reduced insertion and removal force.

The contact blade 4 in the embodiment shown in FIGS. 1 to 5 is provided with soldering posts 22 for soldering the contact blade 4 on a printed circuit board (not shown).

At the tulip contact 3, the electrical connection device 1 has an electrical connection 19 that can be connected to a conductor (not shown).

In the embodiment shown in FIGS. 1 to 5, the electrical connection device 1 can be used as a plug connector and can be plugged onto the contact blade 5 that is attached to a printed circuit board as a current bar.

The necessary contact force is generated by the upper spring 6, for which the upper spring fingers 17 load the pairs of contact fingers 11 in the contact area 7 with a specified spring force. The length 16 of the upper spring fingers 17 is substantially shorter than the length 14 of the contract fingers 15. The effect of this is that the contact fingers 15 make available a large contact surface 18, while the upper spring 6 has a relatively high spring rate so that the spring force generated by the upper spring 6 is substantially higher than any spring force that may be generated at the tulip contact 3.

The upper spring 6 generates the contact force. One of the effects of this is that any settling phenomena at the spring arms 12 and 13 of the tulip contact 3 have no effect, or only a very small effect, on the contact force. For this reason, the tulip contact 3 in the unloaded state has a free opening into which the contact blade 4 can be plugged.

The applicant reserves the right to claim a connection device without a contact blade.

One considerable advantage is the configuration of the spring arms 12 and 13 with several contact spring fingers 15 that are provided on the spring arms 12 and 13 in the shape of blades. In this embodiment, a total of ten contact spring fingers 15 are provided that form five pairs of contact spring fingers overall.

Each contact finger 15 is assigned a corresponding upper spring finger 17 that preloads the respective contact finger 15 with a specified contact force in order to ensure specific conditions upon contact.

Both the upper spring 6 and the tulip contact 3 are preferably produced by bending from single pieces of sheet metal. The flat blanks of the stamped sheet metal parts are shown in FIGS. 4 and 5. A simple and economical production method is ensured, which permits high quality with good producibility.

The upper spring 6 is designed such that a spring steel flat strip is stamped and bent to form a closed cage that completely encloses the flexible side of the tulip's contacts. In addition, the upper spring fingers are shaped to match the number of contact spring fingers 15 on the tulip contact 3.

Push-through protection 10 is provided that prevents a conductor from being pushed through.

The electrical connection device 1 can be used in particular in flat-blade systems with multi-pin connectors. The invention permits use at high current levels while being of a small size at the same time. Even with a 10-pin connector in terminal block construction a very tight spacing of 15 mm, for example, can be ensured, while at the same time the insertion and removal forces required for operation are low.

Trouble-free operation is ensured by a surface containing silver, even when subject to vibration or the effects of constantly changing load.

A floating connection is also possible in which both the tulip contact and the contact blade are located in the plug as well as the connection of the contact blade or the tulip contact by means of appropriate solder pins in one terminal block.

In spite of low clamping forces specifically below 4 N per contact point, the transmission of high currents is ensured continuously, while at the same time operating comfort is increased. One of the ways this is achieved here is that the upper spring in the contact area generates the contact force. At the same time, the electrical connection device 1 in accordance with the invention is economical to produce.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed:

1. An electrical connection device for transmitting high current levels comprising:

a contact blade including a blade thickness;

a tulip contact including:

a plurality of pairs of contact fingers, each pair of contact fingers including a first contact finger that is opposed to and spaced apart from a second contact finger, the first and the second contact fingers extend toward each other at a first angle, the first and the second contact fingers each include a first length and opposing contact portions; and a contact area defined between the opposing contact portions of the first and second contact fingers, the contact area configured to receive the contact blade;

an upper spring including a plurality of pairs of spring fingers, each pair of spring fingers including a first spring finger that is opposed to and spaced apart from a second spring finger, the first and the second spring fingers extend toward each other at a second angle, the first and the second spring fingers each include a second length;

wherein the tulip contact is seated within the upper spring and each pair of contact fingers is between a different pair of spring fingers, the spring fingers apply contact force to the contact fingers to compress the first and second contact fingers together and compress each pair of contact fingers against the contact blade;

wherein the second angle is greater than the first angle;

wherein the first length is greater than the second length; and wherein contact between the contact fingers and the contact blade is operable to permit transmission of current greater than 80 amperes;

wherein the tulip contact includes at least three pairs of contact fingers;

wherein the upper spring includes a housing and at least three pairs of spring fingers;

wherein push-through protection is connected between the pairs of contact fingers; and wherein each of the contact fingers are longer than each of the spring fingers.

2. The electrical connection device of claim 1, wherein contact pressure for each pair of contact fingers largely determined by the spring fingers of the upper spring can be configured such that transmission of current levels above 80 amperes is rendered practicable.

3. The electrical connection device of claim 1 that is designed for contact forces below 20 N.

4. The electrical connection device of claim 1, wherein contact forces below 5 N are present at each pair of contact fingers.

5. The electrical connection device of claim 1, wherein at least one contact portion of the tulip contact is provided with a layer containing silver.

6. The electrical connection device of claim 1, wherein the connection device is further configured such that it is suitable for the transmission of current levels above 100 amperes.

7. The electrical connection device of claim 1, wherein the contact portions include copper and/or the upper spring includes steel.

8. The electrical connection device of claim 1, wherein the contact area includes a free entry width that approximately corresponds to the thickness of the contact blade when the contact fingers are not compressed by the spring fingers.

9. An electrical connection device comprising:

a contact blade with a predetermined blade thickness;

a tulip contact including a plurality of contact fingers arranged in pairs and configured to receive the contact blade, the contact fingers of each pair oppose one another and are spaced apart at a distance generally corresponding to the blade thickness of the contact blade; and an upper spring including a plurality of spring fingers operable to press upon the contact fingers, the spring fingers corresponding in number with the contact fingers;

wherein the tulip contact includes at least three pairs of contact fingers;

wherein the upper spring includes a housing and at least three pairs of spring fingers;

wherein push-through protectio is connected between the pairs of contact fingers; and wherein each of the contact fingers is longer than each of the spring fingers.

10. The electrical connection device of claim 9, wherein opposing spring fingers are arranged at a first angle relative to one another and opposing contact fingers are arranged at a second angle relative to one another, the first angle is greater than the second angle.

* * * * *